United States Patent [19]

Yokoyama

[11] Patent Number: 4,917,043

[45] Date of Patent: Apr. 17, 1990

[54] DEVELOPING DEVICE IN AN IMAGE FORMING APPARATUS

[75] Inventor: Tomoaki Yokoyama, Osaka, Japan

[73] Assignee: Minolta Camera Kabushiki Kaisha, Osaka, Japan

[21] Appl. No.: 247,068

[22] Filed: Sep. 20, 1988

[30] Foreign Application Priority Data

Sep. 21, 1987 [JP] Japan ..... 62-236968

[51] Int. Cl.[4] ..... G03G 15/09

[52] U.S. Cl. ..... 118/658; 118/653; 355/251; 355/253

[58] Field of Search ..... 430/120, 122; 118/658, 118/657, 653; 355/251, 253

[56] References Cited

U.S. PATENT DOCUMENTS 4,522,907 6/1985 Mitsuhashi et al. ..... 118/653 X

FOREIGN PATENT DOCUMENTS 0250666 11/1986 Japan ..... 355/3 DD 0083778 4/1987 Japan ..... 355/3 DD

*Primary Examiner*—R. L. Moses

*Attorney, Agent, or Firm*—Wenderoth, Lind & Ponack

[57] ABSTRACT

A developing device in an image forming apparatus which having a developing sleeve disposed in face-to-face relationship with a photoreceptor drum, a magnetic roller disposed inside the developing sleeve for forming a magnetic brush of developing material on an outer peripheral surface of the developing sleeve for the developing of a latent image on the photoreceptor drum, and a casing enclosing the developing sleeve and having a portion which is held in contact with the magnetic brush. Portions of the casing are formed of or with a toner adherence preventive material of a type capable of being charged to the same polarity as that of the toner particles when held in frictional contact with the material used to charge the toner particles.

15 Claims, 1 Drawing Sheet

DEVELOPING DEVICE IN AN IMAGE FORMING APPARATUS

BACKGROUND OF THE INVENTION

1. Field of the Invention

The present invention generally relates to an electrophotographic image forming apparatus such as a copying machine and, more particularly, to a developing device utilized in the electrophotographic image forming apparatus for developing a powder image.

2. Description of the Prior Art

A developing device is known which comprises a developer tank accommodating therein a mass of developing material, a developing sleeve having a magnetic roller and supported within the developer tank with a portion of the outer peripheral surface thereof exposed towards a photosensitive drum through a rectangular opening defined in the wall of the developer tank. This known developing device is so designed and so operable that the mass of the developing material mixed within the developer tank can be supplied onto the outer peripheral surface of the developing sleeve to form a magnetic brush which is subsequently utilized to develop an electrostatic latent image, formed on the outer peripheral surface of the photosensitive drum, into a toner image.

In this prior art developing device, in order to avoid any possible fall of particles of the developing material out from a gap defined in the vicinity of the rectangular opening between an inner surface of the developer tank and the developing sleeve, the gap defined between the inner surface of the developer tank and the outer peripheral surface of the developing sleeve is limited to a predetermined size, for example, 1.5 mm.

In the case of a compact, medium or low speed copying machine wherein the developing sleeve has a relatively small diameter and also has a small number of magnetic poles, the magnetic poles within the developing sleeve are carefully positioned to permit the developing sleeve to exert magnetic forces of attraction thereby to minimize separation from the developing sleeve the particles of the developing material which have been attracted onto the developing sleeve.

In this prior art developing device, it has, however, been found that the gap between the inner surface of the developer tank and the developing sleeve tends to be narrowed when particles of the developing material adhere to the inner surface of the developer tank. Once this occurs, some of particles of the developing material often fall out from the rectangular opening and contaminate some component parts of the copying machine disposed beneath the rectangular opening, possibly because an increased resistance acts on magnetic brush bristles then revolving in sliding contact with the inner surface of the developer tank. Depending on the design and location of the developing device within the machine, the developing particles falling down may contaminate copying papers and will constitute a cause of reduction in copy quality.

SUMMARY OF THE INVENTION

The present invention has been developed with a view to substantially eliminating the above discussed problems inherent in the prior art developing device and has for its essential object to provide an improved developing device wherein particles of the developing material will neither adhere to the inner surface of the developer tank nor fall out from the developer tank.

In an attempt to find the cause of fall-off or leakage of particles of the developing material from the gap between the developing sleeve and the developer tank, a series of simulated experiments have been conducted to determine how a combination of one of the following materials for the inner surface of the developer tank and one of the following types of developing material, with respect to a gap of various sizes, would affect the presence or absence of the fall-off or leakage of the developing particles and also the adherence of the developing particles to the inner surface of the developer tank.

Types of Developing Material:

Toner Particles Ta of a type capable of being triboelectrically charged to a negative polarity when in frictional contact with a carrier C.

Toner Particles Tb of a type capable of being triboelectrically charged to a positive polarity when in frictional contact with the carrier C.

Material For Tank Inner Surface:

ABS resin, and

Polyester resin which is identical with that used as a principal material for the toner particles Ta.

During the test conducted, the position of a regulating gap defined between the peripheral surface of the developing sleeve and a bristle height regulating member secured to the developer tank was fixed to enable the developing sleeve to carry an equal amount of the toner particles and the concentration of the toner particles was also fixed to a constant value, i.e., 10%. The triboelectric charge system of the carrier C, the toner particles Ta and Tb, the ABS resin and the polyester resin is illustrated in FIG. 2.

Results of the test are tabulated in Tables 1 and 2 below.

TABLE 1

| | | Particle Fall-off | |
|---|---|---|---|
| Toner Type | Gap Size | ABS Resin | Polyester Resin |
| Ta | 0.40 | Not Occurred | Not Occurred |
| | 0.35 | Occurred | Not Occurred |
| | 0.30 | Occurred | Not Occurred |
| | 0.45 | Not Occurred | Not Occurred |
| Tb | 0.40 | Not Occurred | Occurred |
| | 0.35 | Occurred | Occurred |

TABLE 2

| | Adherence to Tank Inner Surface | |
|---|---|---|
| Toner Type | ABS Resin | Polyester Resin |
| Ta | Too much observed | Almost not observed |
| Tb | Almost not observed | Too much observed |

As can be understood from Table 1, where the developing material comprising the carrier C and the toner particles Ta is employed, the use of the polyester resin as a material for the inner surface of the developer tank is effective to eliminate the fall-off of some of the toner particles, and, where the developing material comprising the carrier C and the toner particles Tb is employed, the use of the ABS resin as a material for the inner surface of the developer tank is effective to make it difficult for some of the toner particles to fall off.

In particular, Table 1 illustrates that, as can be readily understood from the triboelectric charge system shown in FIG. 2, if the material for the inner surface of the developer tank is of a kind capable of being charged to the same polarity as that of the toner particles when held in frictional contact with the carrier C, the possibility of fall-off or leakage of some of the toner particles can be eliminated.

Also, as can be understood from Table 2, the use of the toner material comprising the carrier C and the toner particles Ta in combination with the polyester resin as the material for the inner surface of the developer tank is effective to eliminate the adherence of some of the toner particles to the inner surface of the developer tank and, on the other hand, the use of the toner material comprising the carrier C and the toner particles Tb in combination with the ABS resin is also effective to eliminate the adherence of some of the toner particles to the inner surface of the developer tank.

In particular, Table 2 illustrates that, when the inner surface of the developer tank is charged to the same polarity as the toner particles when held in frictional contact with the carrier C, no toner particle will adhere thereto by the effect of electrostatic forces of repulsion, but when the inner surface of the developer tank is charged to a polarity opposite to that of the toner particles when held in frictional contact with the carrier C, adherence of some of the toner particles will occur by the effect of electrostatic forces of attraction. Table 2 also illustrates that, if the inner surface of the developer tank is of material capable of being readily triboelectrically charged in frictional contact with the toner particles, some of the toner particles tend to electrostatically firmly adhere to the inner surface of the developer tank, but if the inner surface of the developer tank is of material difficult to be triboelectrically charged in frictional contact with the toner particles, no toner particles will adhere to the inner surface of the developer tank.

The results of the test have made it clear that, because the surface condition of the inner surface of the developer tank has changed as a result of the adherence of some toner particles thereto and/or because the gap between the inner surface of the developer tank and the peripheral surface of the developing sleeve has been narrowed as a result of the adherence of a substantial amount of toner particles, a great deal of resistance acts on the magnetic brush bristles revolving in sliding contact with the inner surface of the developer tank receive and, therefore, some of the toner particles forming the magnetic brush bristles are fallen off the bristles and then downwardly by the action of a gravitational force.

The present invention is based on the finding of the above discussed phenomenon and is featured in that that portion of the developer tank which are held in contact with the developing material is formed of a toner adherence preventive material of a type capable of being charged to the same polarity as that of the toner particles when held in frictional contact with a material used to charge the toner particles.

According to the present invention, the inner surface of the developer tank formed of the toner adherence preventive material can be charged to the same polarity as that of the toner particles when held in frictional contact with the material such as a carrier used to charge the toner particles, to avoid the electrostatic attraction of the toner particles to the inner surface of the developer tank. Because of this features, the developing material within the developer tank forms a continuous smooth flow without being detained inside the developer tank and, in particular, at a confronting region where it confronts the developing sleeve, the narrowing of the gap between the inner surface of the developer tank and the developing sleeve which will takes place when the toner particles adhere to the inner surface of the developer tank will not occur. Therefore, the magnetic brush bristles formed on the developing sleeve can slidingly engage the inner surface of the developer tank while receiving a predetermined resistance, with no toner particle being fallen off.

BRIEF DESCRIPTION OF THE DRAWINGS

This and other objects and features of the present invention will become readily understood from the following description taken in conjunction with a preferred embodiment thereof with reference to the accompanying drawings, in which.

DETAILED DESCRIPTION OF THE EMBODIMENT

Figure 1:
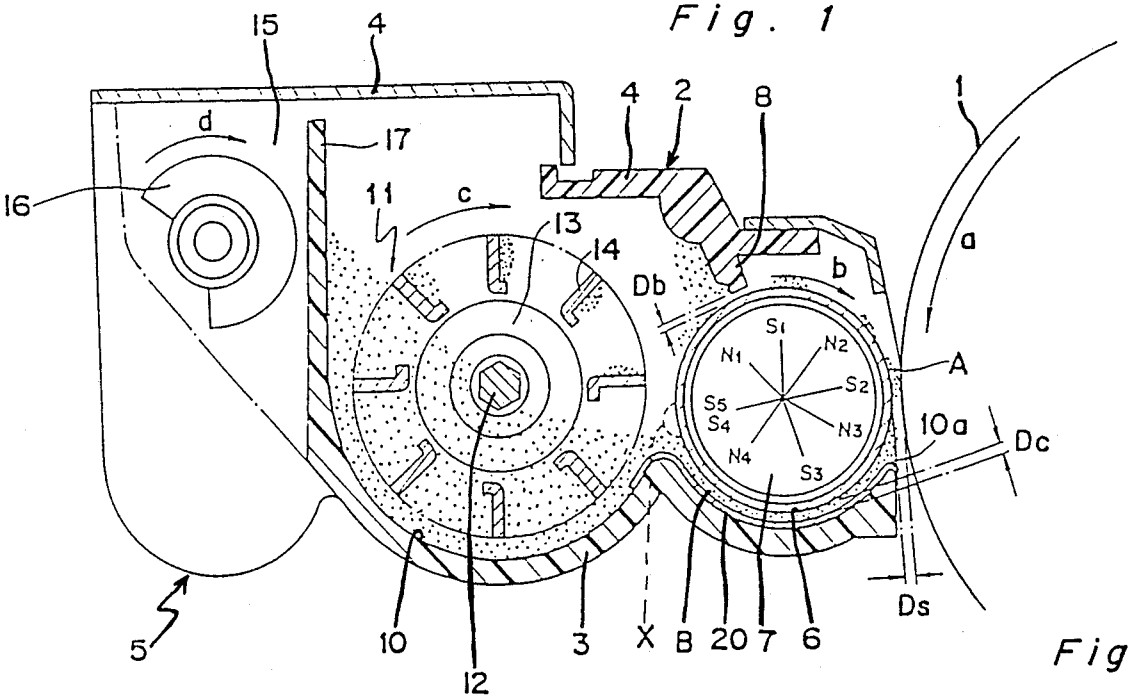
FIG. 1 is a transverse sectional view of a developing device shown in relation to a photoreceptor drum in an electrophotographic copying machine.
Figure 2:
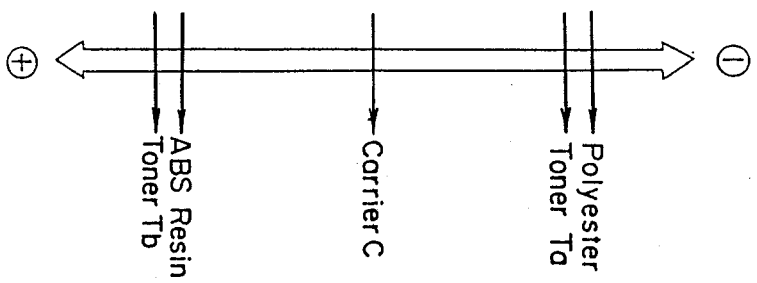
FIG. 2 is a diagram showing a triboelectric charge system.

Referring to FIG. 1, reference numeral 1 represents a photoreceptor drum of any known construction having an organic light sensitive layer formed on an outer peripheral surface thereof. This photoreceptor drum 1 may be 80 mm in outer diameter and is supported for rotation at a peripheral speed of, for example, 180 mm/sec. in a counterclockwise direction shown by the arrow a.

A developing device 2 is disposed at a developing station A in the vicinity of the outer peripheral surface of the photoreceptor drum 1 and comprises a developer tank 5 which generally includes a box-like casing 3 of one-piece construction made of ABS resin and a lid 4. The developer tank 5 has three chambers defined therein and accommodates therein a developing sleeve 6 having a magnetic roller assembly 7 built therein, a bucket roller 11 and a toner supply roller 16. These chambers include a sleeve chamber closest to the photoreceptor drum 1 and housing the developing sleeve 6 therein, a toner supply chamber 15 remote from the photoreceptor drum 1 and supporting therein the toner supply roller 16 for rotation in one direction shown by the arrow d, and a mixing and delivery chamber 10 defined intermediate between the sleeve chamber and the toner supply chamber 15 and housing the bucket roller 11 therein. The mixing and delivery chamber 10 and the toner supply chamber 15 are partitioned from each other by an upright partition wall 17 extending from a bottom wall of the casing 3 towards the lid 4. A front wall of the casing 3 adjacent the photoreceptor drum 1 is apertured to have a generally rectangular opening through which a portion of the outer peripheral surface of the developing sleeve 6 confronts the photoreceptor drum 1.

The developing sleeve 6 is a hollow cylinder, 24.5 mm in outer diameter, made of non-magnetizeable, electroconductive material, for example, aluminum, and having its outer peripheral surface roughened by the use of a sandblasting technique to have fine surface irregularities of about 5 to 10 μm. Within the sleeve chamber, the developing sleeve 6 is supported for rotation in a clockwise direction at a speed of 193 rpm and is spaced a minimum distance Ds of 0.55 mm from the outer peripheral surface of the photoreceptor drum 1. The developing sleeve 6 so supported is also spaced from a bristle height regulating plate 8, formed in a top wall of the casing 3 so as to depend therefrom towards the developing sleeve 6, a minimum distance Db of 0.45 mm between the outer peripheral surface of the developing sleeve 6 and a free edge of the bristle height regulating plate 8. It is to be noted that the space represented by the minimum distance Ds between the developing sleeve 6 and the photoreceptor drum 1 will be hereinafter referred to as the developing gap Ds and, similarly, the space represented by the minimum distance Db between the developing sleeve 6 and the bristle height regulating plate will be hereinafter referred to as the regulating gap Db.

Also, the outer peripheral surface of the developing sleeve 6 is spaced a uniform distance Dc from an inner surface of that portion of the bottom wall of the casing 3 which confronts the developing sleeve 6, the spacing of the distance Dc being hereinafter referred to as a bottom gap B. This bottom gap B is so selected and so sized that tips of magnetic brush bristles formed on the outer peripheral surface of the developing sleeve 6 can lightly touch that portion of the bottom wall of the casing 3.

A toner adherence preventive layer 20 made of material capable of being charged to the same polarity as that of toner particles when held in sliding contact with a carrier is formed on that portion of the bottom wall of the casing 3 so as to extend over a region from a lower lip region, indicated by 10*a*, of the rectangular opening in the front wall of the casing 3 to a location a slight distance over the boundary hill which is formed in the bottom wall of the casing between the sleeve chamber and the toner supply chamber. So far illustrated, the toner adherence preventive layer 20 is employed in the form of a layer of polyester resin coated on the bottom wall of the casing 3 over that region.

The magnetic roller assembly 7 is fixedly housed inside the developing sleeve 7 and has its peripheral region magnetized to magnetic poles N1 to N4 and S1 to S3 and, in particular, that portion of the magnetic roller assembly 7 which is remote from the photoreceptor drum 1 and on an upstream side with respect to the direction in which the magnetic brush bristles are conveyed by the rotation of the developing sleeve 3 towards the photoreceptor drum 1 is magnetized to identical auxiliary poles S4 and S5. The poles S2 is magnetized to exert a magnetic force of 950 gauss, any one of the poles S1, S3 and N1 to N3 is magnetized to exert a magnetic force of 800 gauss, the pole N4 is magnetized to exert a magnetic force of 500 gauss, and the auxiliary poles S4 and S5 are magnetized to exert a magnetic force of not higher than 500 gauss thereby to form a magnetic field of repulsion as indicated by X.

The bucket roller 11 disposed inside the mixing and delivery chamber 10 comprises a support shaft 12 having a screw feeder 13 mounted thereon. The screw feeder 13 has a spiral blade of 34 mm in maximum diameter formed with a plurality of buckets 14 spaced an equal distance from each other and is adapted to be driven at a speed of 291 rpm in a direction, shown by the arrow c, conforming to the direction of rotation of the developing sleeve 6.

Although not shown, the partition wall 17 separating the mixing and delivery chamber 10 and the toner supply chamber 15 from each other has an opening defined therein at a location adjacent one end of the shaft 12 so that the developing material within the toner supply chamber 15 can, after having been conveyed by the rotation of the toner supply roller 16, be supplied into the mixing and delivery chamber 10.

As hereinbefore discussed, material for the toner adherence preventive layer 20 must be of a type capable of being charged to the same polarity as that of the toner particles when held in frictional contact with the carrier used in the developing material and may be selected from the group consisting of the following materials.

(1) In terms of the triboelectric charge system, that material which lies on one side of the carrier close towards the toner particles and farther from the carrier than to the toner particles, such as, for example, Teflon (Reg. Trademark owned by Du Pont), polyethylene, or polyester resin.

(2) Synthetic resin which is the same as the toner particles, such as, for example, polyester resin.

(3) Synthetic resin which is the same as the toner particles and contains the same charge imparting additive as used in the toner particles, such as, for example, polyester resin containing charge imparting pigments.

(4) Synthetic resin which is the same as the toner particles and contains the same percent by weight of the same charge imparting additive as used in the toner particles.

Of these materials (1) to (4) listed above, the use of the material (4) is most preferred, followed by the materials (3), (2) and (1) in the order given above.

It is, however, to be noted that a specific example of any one of the materials (1) to (4) listed above may vary depending on the particular composition of the developing material used as will now be discussed.

Where the developing material is of the composition tabulated in Table 3, the material (1) includes Teflon, polyethylene, polyester resin; the material (2) includes polyester resin; the material (3) includes polyester resin containing chargeable pigments; and the material (4) includes polyester resin containing 2% of chargeable pigments and 0.1% of silica.

TABLE 3

| Composition of Developing Material (D1) | | |
|---|---|---|
| Toner T1: | Polyester resin ("TUFTON NE1110" made and sold by KAO Co., Ltd.) | 91.0 wt. % |
| | Carbon black ("MA #8" made and sold by Mitsubishi Chemical Industrie Co., Ltd.) | 4.5 wt. % |
| | Chargeable pigments ("Aizen Spilon Black TRH" made and sold by Hodogaya Chemical Industries, Ltd.) | 1.8 wt. % |
| | Polypropylene ("VISCOL TS200" made and sold by Sanyo Chemical Industries, Ltd.) | 2.3 wt. % |
| | Titanium oxide ("AEROSIL T805" made and sold by Nippon Aerosil Co., Ltd.) | 0.3 wt. % |
| | Silica ("R-976" made and sold by Nippon Aerosil Co., Ltd.) | 0.1 wt. % |
| Carrier C: | Polyester resin ("TUFTON NE1110" made and sold by KAO Co., Ltd.) | 16.6 wt. % |
| | Magnetic powder ("MFP-2" made and sold by TDK Co., Ltd.) | 82.9 wt. % |
| | Carbon black | 0.33 wt. % |

TABLE 3-continued

| Composition of Developing Material (D1) | |
|---|---|
| ("KETCHEN BLACK EC" made and sold by Lion Akzo Co., Ltd.) | |
| Silica ("AEROSIL #200" made and sold by Nippon Aerosil Co., Ltd.) | 0.25 wt. % |

Where the developing material is of the composition tabulated in Table 4, the material (1) includes acryl, polystyrene, styrene-acryl and ABS resin; the material (2) includes styrene-acrylic resin; the material (3) includes styrene-acrylic resin containing chargeable pigments; and the material (4) includes styrene-acrylic resin containing 5% of chargeable pigments and 0.1% of silica.

TABLE 4

| | Composition of Developing Material (D2) | |
|---|---|---|
| Toner T2: | Styrene-acrylic resin ("ALMATEX 724M" made and sold by Mitsui Toatsu Chemical Co., Ltd.) | 84.7 wt. % |
| | Carbon black ("MA #8" made and sold by Mitsubishi Chemical Industries, Ltd.) | 3.0 wt. % |
| | Chargeable pigments ("NYGROSINE BASE EXM" made and sold by Orient Chemical Industries, Ltd.) | 4.2 wt. % |
| | Copper oxide ("N-122" made and sold by Nisshin Chemical Industries, Ltd.) | 5.9 wt. % |
| | Polypropylene ("VISCOL TS200" made and sold by Sanyo Chemical Industries, Ltd.) | 2.1 wt. % |
| | Silica ("R-976" made and sold by Nippon Aerosil Co., Ltd.) | 0.1 wt. % |
| Carrier C: | Polyester resin ("TUFTON NE1110" made and sold by KAO Co., Ltd.) | 16.6 wt. % |
| | Magnetic powder ("MFP-2" made and sold by TDK Co., Ltd.) | 82.9 wt. % |
| | Carbon black ("KETCHEN BLACK EC" made and sold by Lion Akzo Co., Ltd.) | 0.33 wt. % |
| | Silica ("AEROSIL #200" made and sold by Nippon Aerosil Co., Ltd.) | 0.25 wt. % |

The developing device 2 of the above described construction operates in such a way that, when and after a quantity of the toner material is supplied into the toner supply chamber 15 through a toner hopper (not shown) and when an empty condition is subsequently detected by a toner density detecting sensor (not shown), the toner supply roller 16 is driven in the direction shown by the arrow d to move a mass of the toner material towards the rear of the bucket roller 11. The mass of the toner material so supplied into the mixing and delivery chamber 10 is mixed with the developing material consisting of toner particles and carrier particles and remaining within the mixing and delivery chamber 10 and is then conveyed by the screw feeder 13 from one end towards the opposite end of the chamber in a direction generally parallel to the longitudinal axis of the bucket roller 11 as a result of rotation of the bucket roller 11 in the direction shown by the arrow c. During this conveyance of the developing material, the toner particles and the carrier particles are uniformly mixed to improve the potential charge on the toner particles.

At the same time, the developing material being uniformly mixed is in part conveyed by the buckets 14 onto the outer peripheral surface of the developing sleeve 6, and the developing material when so conveyed onto the developing sleeve 6 forms magnetic brush bristles on the outer surface of the developing sleeve 6 under the influence of magnetic forces developed from the magnetic roller assembly 7.

The developing material retained on the outer peripheral surface of the developing sleeve 6 in the form of the magnetic brush bristles is, during the rotation of the developing sleeve 6 in the direction shown by the arrow b, transported towards the developing station A at which the magnetic brush bristles are held in contact with the outer peripheral surface of the photoreceptor drum 1, the consequence of which is that toner particles forming the magnetic brush bristles together with the carrier particles are attracted towards the photoreceptor drum 1 to develop an electrostatic latent image on the photoreceptor drum 1 into a visible toner image.

The amount of the developing material supplied onto the photoreceptor drum 1 in the form of the magnetic brush bristles is regulated by the bristle height regulating plate 8 during the passage thereof through the regulating gap Db.

Subsequent to the development of the electrostatic latent image into the toner image, the magnetic brush bristles containing the portion of the developing material which is not used for the development is, during the continued rotation of the developing sleeve 6, conveyed towards the bottom gap B between that portion of the bottom wall of the casing 3 and the developing sleeve 6. During the passage of the magnetic brush bristles through the bottom gap B while such magnetic brush bristles are still retained by the developing sleeve 6, tips of the magnetic brush bristles sweep the inner surface of that portion of the bottom wall of the casing 3 in contact therewith.

However, because of the provision of the toner adherence preventive layer 20 formed on the inner surface of that portion of the bottom wall of the casing 3, which layer 20 is made of the material (i.e., polyester resin in the illustrated embodiment) of a type capable of being charged to the same polarity as that of the toner particles when held in frictional contact with the carrier particles, the toner particles forming the magnetic brush bristles then passing through the bottom gap B are not attracted towards and do not adhere to the inner surface of the bottom wall of the casing 3. Therefore, a surface of the adherence preventive layer 20 facing the developing sleeve 6 remains substantially smooth and does not constitute a resistance to the movement of the magnetic brush bristles carried by the developing sleeve 6.

Accordingly, the possibility, hitherto experienced, of toner particles adhering to the inner surface of the casing 3, as a result of the frictional contact therewith, to form an aggregation of toner material which will in turn result in a clogging of the toner particles at the bristle height regulating gap DB can be eliminated. The clogging of the toner particles at the regulating gap Db would constitute a cause of uneven formation of the magnetic brush bristles on the developing sleeve which in turn would result in the reduction of image quality, for example, the appearance of white fringes in the image copied and/or black dots of high toner density.

The developing material carried by the developing sleeve 6 through the bottom gap B is conveyed towards a portion of the mixing and delivery chamber 10 remote from the photoreceptor drum 1 and is separated from the developing sleeve 6 by the action of the magnetic force of repulsion X as it approaches a region where the auxiliary magnetic poles S4 and S5 are situated. The developing material so separated from the developing sleeve 6 then collides with the developing material being conveyed by the buckets 14 of the bucket roller 11 and is urged towards the bucket roller 11.

Although the present invention has been fully described in connection with the preferred embodiment thereof with reference to the accompanying drawings, it is to be noted that various changes and modifications are apparent to those skilled in the art. By way of example, although in the foregoing embodiment the toner adherence preventive layer 20 has been shown and described as deposited on the inner surface of that portion of the bottom wall of the casing 3 and in the vicinity thereof, it may be formed on the entire inner surface of the casing 3 including an inner surface of the lid 4, or on that portion of the inner surface of the casing 3 which contacts the developing material accommodated therein, and an inner surface of the lid 4. Alternatively, both of the casing 3 and the lid 4 may be made of a specific material of a type capable of being charged to the same polarity as that of the toner particles when held in frictional contact with the carrier particles.

Also, although reference has been made to the use of developing material of a two-component type including toner particles and carrier particles, the present invention can be equally applicable to a developing device utilizing a developing material of a one-component type. Where the use of the developing material of a one-component type is made, material which can be triboelectrically charged to the same polarity as that of the toner particles may be used for magnetizeable particles for charging the toner particles and also for a blade member.

Again, the present invention can be equally applicable to a developing device wherein the magnetic roller assembly 7 is rotatably supported inside the developing sleeve 6. However, the application to the developing device wherein the magnetic roller assembly 7 is fixedly supported inside the developing sleeve 6 such as shown and described is particularly advantageous in that the force necessary to transport the developing material carried by the developing sleeve 6 can be minimized.

Accordingly, such changes and modifications are to be construed as included within the scope of the present invention unless they depart therefrom.

I claim:

1. A developing device, comprising:

a developing sleeve for being disposed in face-to-face relationship with a latent image carrier medium;

a magnetic means disposed inside said developing sleeve for forming a magnetic brush of developing material on an outer peripheral surface of said developing sleeve for developing a latent image on said carrier medium;

a casing enclosing said developing sleeve and having a portion for contacting the magnetic brush; and means for preventing adherence of toner to said portion, said means comprising said portion of said casing being formed of a toner adherence preventive material of a type capable of being charged to the same polarity as that of toner particles when held in frictional contact with material used to charge the toner particles.

2. The developing device as claimed in claim 1, wherein said toner adherence preventive material and the toner particles are formed of the same synthetic resin.

3. The developing device as claimed in claim 2, wherein said toner adherence preventive material and the toner particles contain the same charge imparting additive.

4. The developing device as claimed in claim 1, wherein the developing sleeve is rotatably supported inside said casing and said magnetic means if fixedly supported inside said casing.

5. A developing device as claimed in claim 1, wherein said portion held in contact with the magnetic brush is located under said sleeve.

6. A developing device as claimed in claim 1, wherein said casing has a curved surface facing said outer surface of said developing sleeve with a predetermined gap.

7. A developing device as claimed in claim 1, wherein said portion is a curved surface adjacent to said outer surface of said developing sleeve for contact with the magnetic brush.

8. A developing device as claimed in claim 7, wherein the material used to charge the toner particles is a magnetic carrier with which the toner particles form the magnetic brush.

9. A developing device comprising:

a developing sleeve for being disposed in face-to-face relationship with a latent image carrier medium;

a magnetic means disposed inside said developing sleeve for forming a magnetic brush of developer composed of toner and magnetic carrier on an outer peripheral surface of said developing sleeve for developing a latent image on said carrier medium;

a casing enclosing said developing sleeve and having a portion for contacting the magnetic brush; and means for preventing adherence of the toner to said portion, said means comprising said portion of said casing being formed of a toner adherence preventive material of a type capable of being charged to the same polarity as that of the toner when held in frictional contact with material used to charge the toner.

10. A developing device as claimed in claim 9, wherein said toner adherence preventive material and the toner are substantially the same synthetic resin.

11. A developing device as claimed in claim 9, wherein said toner adherence preventive material and the toner contain the same charge imparting additive.

12. A developing device as claimed in claim 9, wherein said developing sleeve is rotatably supported inside the casing and said magnetic means is fixedly supported inside said casing.

13. A developing device comprising:

a developing sleeve for being disposed in face-to-face relationship with a latent image carrier medium;

a magnetic means disposed inside said developing sleeve for forming a magnetic brush of toner material on an outer peripheral surface of said developing sleeve for developing a latent image on said carrier medium;

a casing enclosing said developing sleeve and having a portion opposite to said outer surface of said developing sleeve; and means for preventing adherence of the toner to said portion, said means comprising said portion of said casing being formed of substantially the same synthetic resin as that of the toner material.

14. A developing device as claimed in claim 13, wherein said resin forming said casing contains the same charge imparting additive as contained in the toner material.

15. A developing device as claimed in claim 13, wherein said portion is a curved surface adjacent said outer surface of said developing sleeve for contact with the magnetic brush.

* * * * *